US010494829B2

(12) United States Patent
Lavabre

(10) Patent No.: US 10,494,829 B2
(45) Date of Patent: Dec. 3, 2019

(54) DEVICE FOR CLEANING A SUBMERGED SURFACE WITH A PROPELLED WATER JET

(71) Applicants: Liang Chen, Ningbo (CN); Vincent Lavabre, Balma (FR); Maxime Puech, Dremil-Lafage (FR); L'ATELIER DU 26, Toulouse (FR); Patrick Marie, Quint-Fonsegrives (FR)

(72) Inventor: Vincent Lavabre, Balma (FR)

(73) Assignees: Liang Chen, Ningbo (CN); Vincent Lavabre, Balma (FR); Maxime Puech, Dremil-Lafage (FR); L'ATELIER DU 26, Toulouse (FR); Patrick Marle, Quint-Fonsegrives (FR)

( * ) Notice: Subject to any disclaimer, the term of this patent is extended or adjusted under 35 U.S.C. 154(b) by 979 days.

(21) Appl. No.: 14/404,585

(22) PCT Filed: May 28, 2013

(86) PCT No.: PCT/FR2013/051185

§ 371 (c)(1),
(2) Date: Nov. 28, 2014

(87) PCT Pub. No.: WO2013/178935

PCT Pub. Date: Dec. 5, 2013

(65) Prior Publication Data

US 2015/0143643 A1 May 28, 2015

(30) Foreign Application Priority Data

May 28, 2012 (FR) ..... 12 54892

(51) Int. Cl.
*E04H 4/16* (2006.01)

(52) U.S. Cl.
CPC ..... *E04H 4/1663* (2013.01); *E04H 4/1654* (2013.01)

(58) Field of Classification Search
CPC ..... E04H 4/1663; E04H 4/16; E04H 14/1654; B62D 5/14

(Continued)

(56) References Cited

U.S. PATENT DOCUMENTS 342,247 A † 1/1969 Osborne
3,422,478 A * 1/1969 Osborne ..... E04H 4/1654 15/1.7

(Continued)

FOREIGN PATENT DOCUMENTS

EP 1 022 411 A2 7/2000
FR 2 586 054 A1 2/1987

(Continued)

OTHER PUBLICATIONS

International Search Report issued in PCT/FR2013/051185, dated Nov. 14, 2013.

(Continued)

*Primary Examiner* — Dung Van Nguyen
(74) *Attorney, Agent, or Firm* — Klein, O'Neill & Singh, LLP

(57) ABSTRACT

The invention relates to a device for cleaning a submerged surface comprising water jet propulsion means (19) that generate a propelling water jet, and means (19-23) for orienting the propelling water jet that allow orienting said water jet in two opposing so-called longitudinal propulsion directions, capable of imparting to the cleaning device two opposing directions of movement along an axis of movement (y). In the invention, the means (19-23) for orienting the propelling water jet are suitable for orienting the water jet in at least one third, so-called lateral propulsion direction, in which the water jet is oriented in a bisecting direction (Continued)

Figure 3:
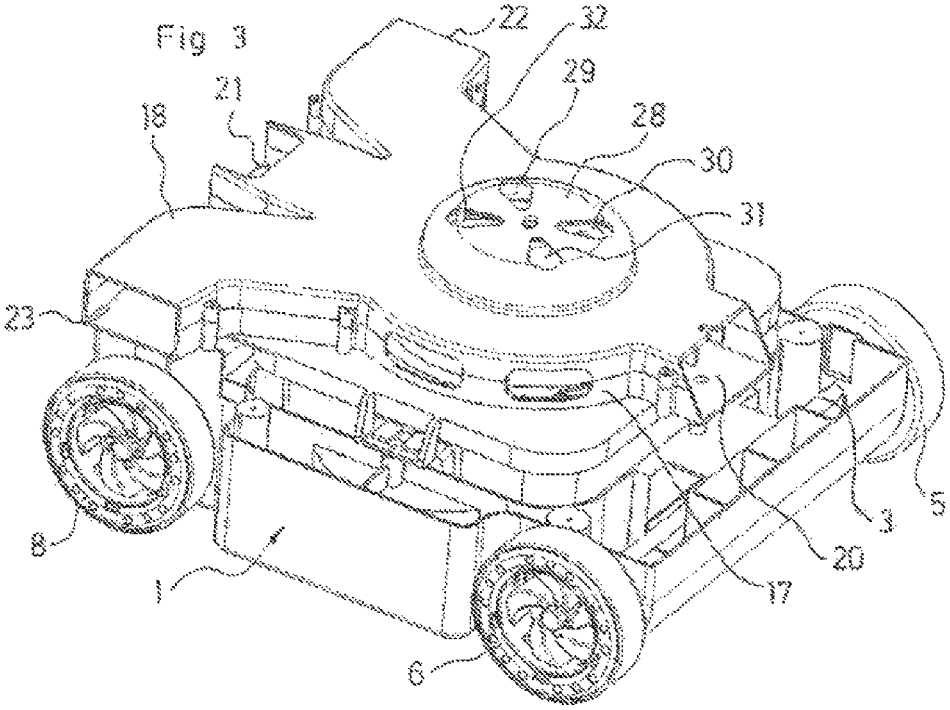

relative to the axis of movement (y) suitable for exerting a force capable of causing the cleaning device to pivot by oversteering.

16 Claims, 7 Drawing Sheets

(58) Field of Classification Search
USPC ..... 15/1.7, 302
See application file for complete search history.

(56) References Cited

U.S. PATENT DOCUMENTS 4,835,809 A 6/1989 Roumagnac
D304,505 S * 11/1989 Maier ..... D32/21
6,412,133 B1 * 7/2002 Erlich ..... E04H 4/1663 15/1.7
7,805,792 B2 * 10/2010 Roumagnac ..... E04H 4/1654 15/1.7
2007/0157413 A1 * 7/2007 Roumagnac ..... E04H 4/1654 15/302
2008/0235887 A1 10/2008 Horvath et al.

FOREIGN PATENT DOCUMENTS

FR 2 896 005 A1 7/2007
WO WO 90/09498 A1 8/1990

OTHER PUBLICATIONS

Written Opinion issued in PCT/FR2013/051185, dated Nov. 14, 2013.

* cited by examiner
† cited by third party

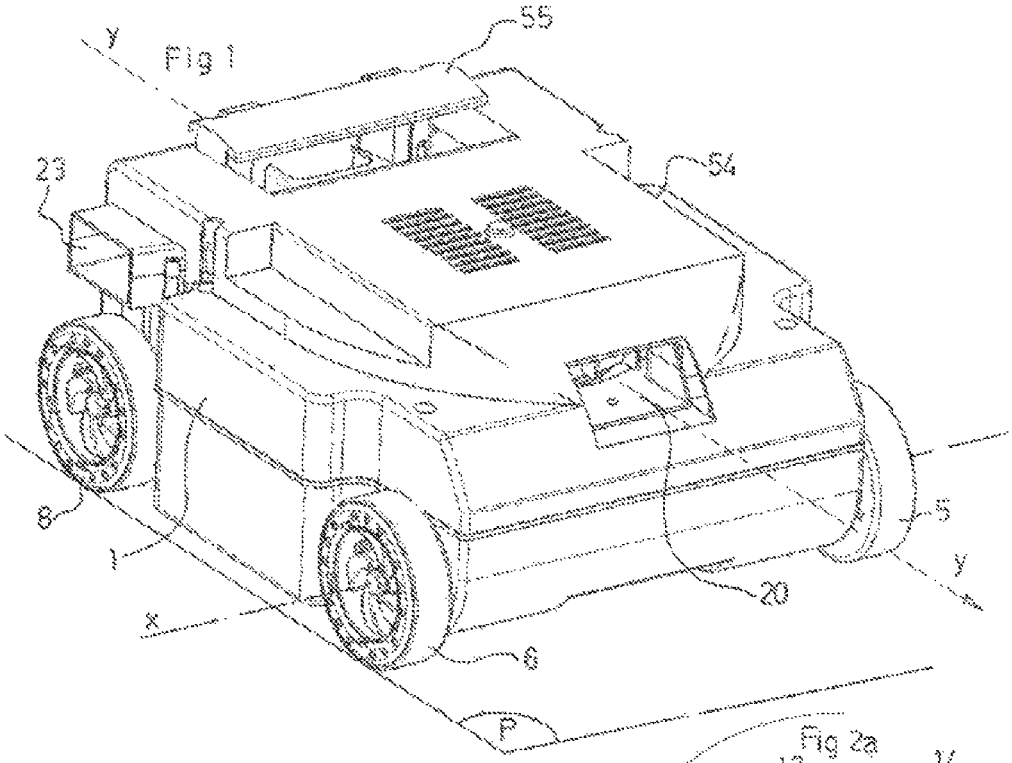
Fig 1
y
55
54
23
8
1
x
6
20
5
y
P
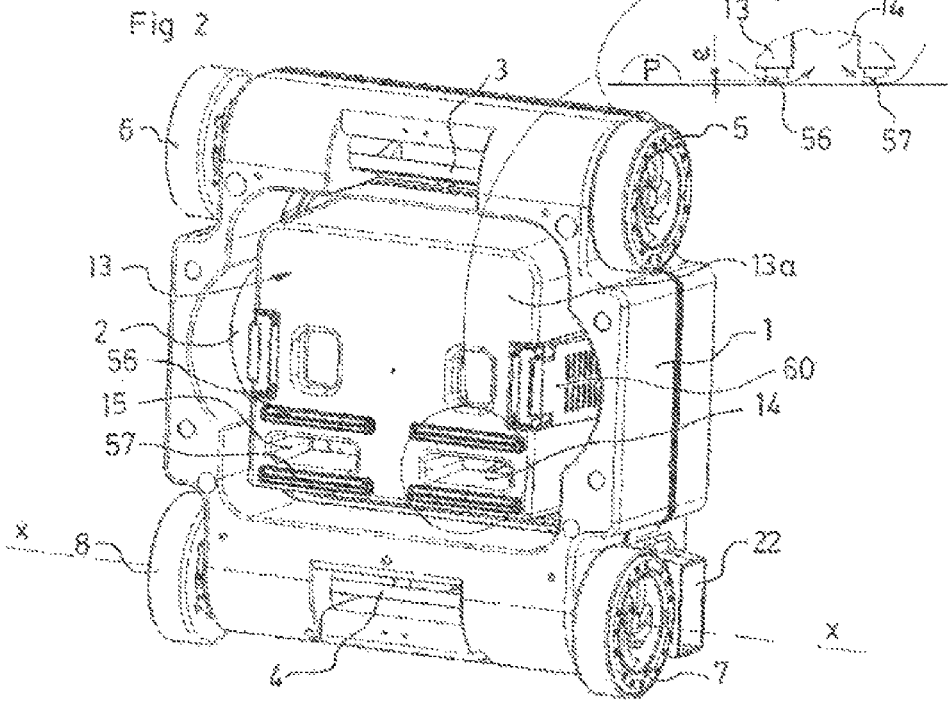
Fig 2
Fig 2a
13
14
P
d
56
57
3
6
5
13
13a
2
56
15
57
1
60
14
x
8
22
x
4
7

DEVICE FOR CLEANING A SUBMERGED SURFACE WITH A PROPELLED WATER JET

The invention relates to a device for cleaning a submerged surface with a propelling water jet.

Devices that clean submerged surfaces with propelling water jets usually include water jet propulsion means that generate a propelling water jet, and means for orienting the propelling water jet that allow orienting said water jet in two opposing propulsion directions, referred to as longitudinal, capable of imparting to the cleaning device two opposing directions of movement along an axis of movement.

Such cleaning devices, in particular those described in patents FR 2896005 and FR 2586054, simply consist of a turbine or a propelling nozzle powered by either onboard drive means or by the discharge circuit of the tank or pool filtration system, and constitute a range of devices designed to travel over the bottom of tanks or pools at a cost that is significantly less than the cost of sophisticated devices designed to travel over the bottom and side walls of the tanks or pools.

However, by their design, these cleaning devices prove unable to ensure complete and systematic coverage of the entire surface of the tanks or pools without requiring human intervention. Indeed, especially in certain situations such as at the end of a sweep over a surface to be cleaned, positioning at the bottom of a slope, etc., such cleaning devices can become stuck with no possibility of escape other than through human intervention.

The present invention aims to overcome this disadvantage and to provide a cleaning device that combines the advantages of current devices with a propelling water jet (simplicity, low cost . . . ) and the ability to clean efficiently the entire surface of the bottoms of tanks or pools without requiring human intervention.

Another aim of the invention is to provide a cleaning device that is simple to use in an optimal manner.

To this end, the invention firstly provides a cleaning device in which the means for orienting the propelling water jet are suitable for orienting the propelling water jet not only in two opposing longitudinal propulsion directions, but also in at least a third propulsion direction, referred to as lateral, in which said water jet is oriented in a bisecting direction relative to the longitudinal axis of movement, suitable for exerting a force capable of causing the cleaning device to pivot by oversteering.

For simplicity in the description, the cleaning device according to the invention is described herein as positioned on a bottom wall of a tank or pool such as a swimming pool, and terms such as upper, lower, above, below, etc. are to be interpreted relative to such positioning.

Such a device for cleaning with a propelling water jet is thus designed to carry out:

- longitudinal movement along the axis of movement, in both directions of movement,
- and predetermined pivoting angles that are functions of the time during which the water jet is oriented in a lateral propulsion direction.

This cleaning device can thus perform movement sequences that incorporate longitudinal displacements and "turns" which, with appropriate programming of said movement sequences determined in particular according to the shape and size of the tank or pool, allow effective cleaning of the entire bottom surface of the tank or pool without requiring human intervention.

According to one advantageous embodiment of the invention, the means for orienting the propelling water jet are suitable for orienting the water jet in two opposing lateral propulsion directions that are symmetrical relative to the axis of movement.

For this purpose, the cleaning device according to the invention advantageously comprises means for controlling the means for orienting the propelling water jet, to generate movement sequences comprising longitudinal displacements along the axis of movement, alternating in the two movement directions, and turns in at least one direction of rotation.

The cleaning device can thus pivot in both directions and therefore has increased movement capability.

In addition, the means for orienting the propelling water jet are advantageously adapted, according to the invention, so that in each lateral propulsion direction, the propelling water jet is ejected near one of the longitudinal ends of the cleaning device, with an orientation at least substantially orthogonal to the axis of movement.

Thus, when the cleaning device comprises a body supported by two rolling assemblies rotatable about axes of rotation, the propelling water jet is advantageously centered, in each lateral propulsion direction, on the axis of rotation of one of the rolling assemblies.

This arrangement provides a maximum torque in each lateral propulsion direction of the propelling water jet, and thus ensures effective and rapid pivoting of the cleaning device.

Moreover, according to another advantageous embodiment of the invention, the means for orienting the propelling water jet comprise:

- a rotary distributor rotating about another axis of rotation, comprising a propulsion duct extending radially relative to said axis of rotation,
- drive means for rotating the rotary distributor,
- and means for indexing the angular position of the propulsion duct about the axis of rotation.

In addition, the means for orienting the propelling water jet advantageously comprise, according to the invention, fixed propulsion outlets:

- arranged so as to lie in the extension of the propulsion duct of the rotary distributor, each in one of the indexed angular positions of said propulsion duct,
- having longitudinal profiles adapted to define the orientation of the propelling water jet.

According to another advantageous embodiment of the invention, the water jet propulsion means comprise a radial turbine rotated about the other axis of rotation by motor means, and:

- the rotary distributor comprises a suction chamber arranged to accommodate the radial turbine, equipped with a passage providing communication with the propulsion duct,
- the drive means for rotating the rotary distributor comprises members for deflecting the water jet generated by the rotation of the turbine.

According to this embodiment, the water suction enabling water filtration and the creation of the propelling water jet are achieved by means of a simple turbine which thus ensures both the filtration and propulsion functions.

According to this embodiment, in addition and in an advantageous manner according to the invention:

- the suction chamber of the rotary distributor comprises a feed opening in the upper area of said suction chamber,
- fluid passageways incorporating filtration means are adapted to allow water to travel between at least one suction port arranged in the lower portion of the cleaning device and the feed opening of the suction chamber.

In addition, the rotary distributor then comprises, advantageously according to the invention, water passage openings arranged opposite the feed opening of the suction chamber and adapted to be unblocked in each of the lateral propulsion positions, and to be blocked in the two longitudinal propulsion positions.

With this arrangement, in the lateral propulsion positions, the suction chamber is fed directly by water entering through the upper water passage openings. Therefore, when pivoting, the cleaning device is not subjected to the adhesive force generated by the negative pressure caused by drawing water through the suction holes (Bemoulli effect).

In addition, when pivoting, the flow from the suction chamber is independent of the fill level and/or clogging level of the filtration means. Therefore, the amplitude of the pivots remains constant regardless of the fill level and/or clogging level, and can be precisely determined.

For simplicity of manufacture, and in particular in order to create these water passage openings, the cleaning device preferably comprises a shroud adapted to accommodate the rotary distributor, in which are formed the fixed propulsion outlets as well as holes intended to match with said water passage openings in each of the two lateral propulsion positions.

According to another advantageous embodiment of the invention, the cleaning device comprises a body having the form of a frame defining a volume able to accommodate a removable filtration pan containing the filtration means and equipped with a lower wall in which each suction port is arranged.

Furthermore, the shape of the body is advantageously adapted so that the cleaning device can be placed on its side in a position permitting removal of the filtration pan. Thus, access to the filtration pan and removal and reinstallation of this pan are greatly facilitated.

In addition, the cleaning device further comprises, advantageously according to the invention, on either side of each suction port, along the longitudinal axis of movement, a lip extending along the edge of said suction port, of a height adapted to define, above the submerged surface, a suction passage of reduced cross-section.

This arrangement leads to accelerating the flow through the suction passages and generates "water jets" in contact with the tank or pool wall, which efficiently clean said wall.

According to another advantageous embodiment of the invention, the indexing means comprise radial stop members projecting from the periphery of the rotary distributor, and an abutment member associated with actuating means able to move said abutment member between positions where it catches the stop members and positions where it is retracted relative to said stop members.

Furthermore, according to this embodiment and advantageously according to the invention:

the radial stop members and the abutment member are arranged so that said abutment member has a first position where it catches the stop members defining the lateral propulsion positions of the rotary distributor, and a second position where it catches the stop members defining the longitudinal propulsion positions of the rotary distributor, the actuating means comprise an active state of maintaining the abutment member in one of its two catch positions and a passive state of maintaining said abutment member in its second catch position.

Furthermore, advantageously according to the invention, these actuating means are electrically powered and have an active state, obtained when power is being received, of maintaining the abutment member in its position of catching the stop members defining the lateral propulsion positions of the rotary distributor, and a passive state, obtained in the absence of power, of maintaining the abutment member in its position of catching the stop members defining the longitudinal propulsion positions of the rotary distributor.

Thus the actuating means are supplied power only during the pivoting phases of the cleaning apparatus, meaning the phases of shorter duration.

As a preferred embodiment of such indexing means:

the stop members defining the lateral propulsion positions of the rotary distributor are offset, along an axis parallel to the other axis of rotation, relative to the stop members defining the longitudinal propulsion positions of said rotary distributor, the abutment member consists of a lever hinged on a pivot axis orthogonal to a radial axis relative to the other axis of rotation, the actuating means comprise an electromagnet adapted to pivot the abutment member about its pivot axis.

Figure 4:
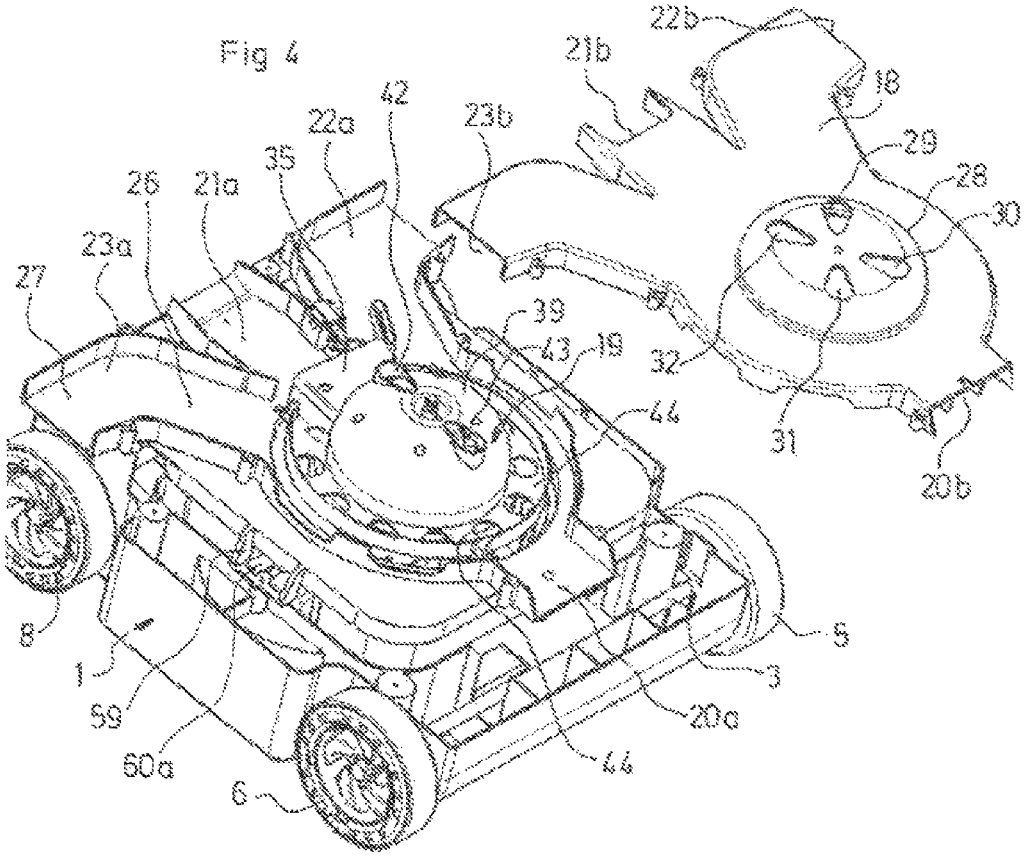
Figure 5:
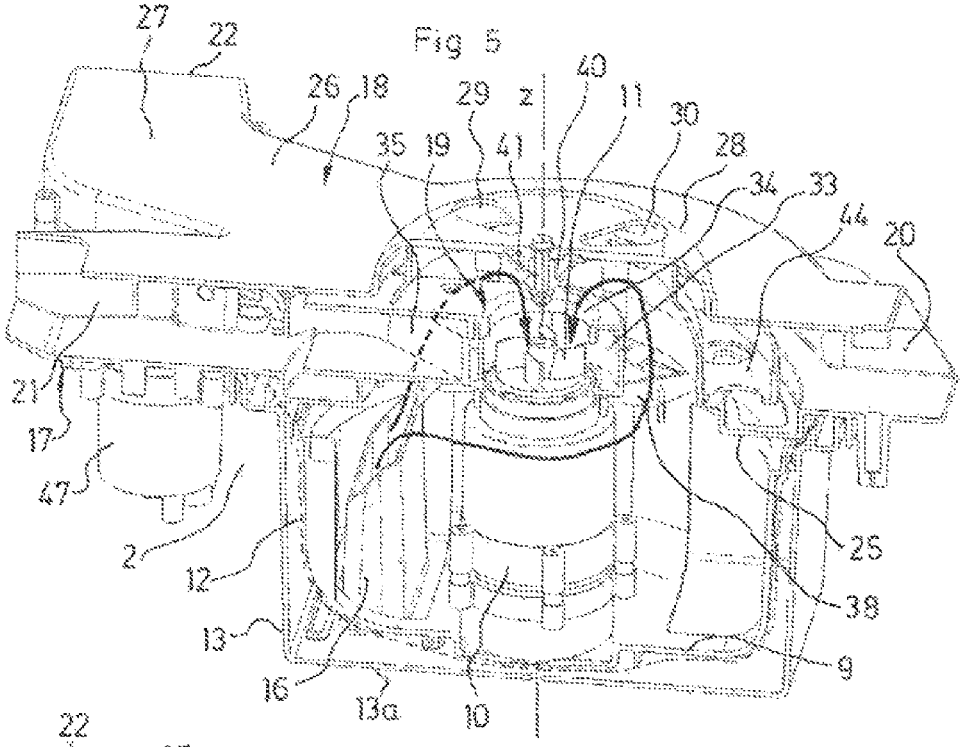
Figure 6:
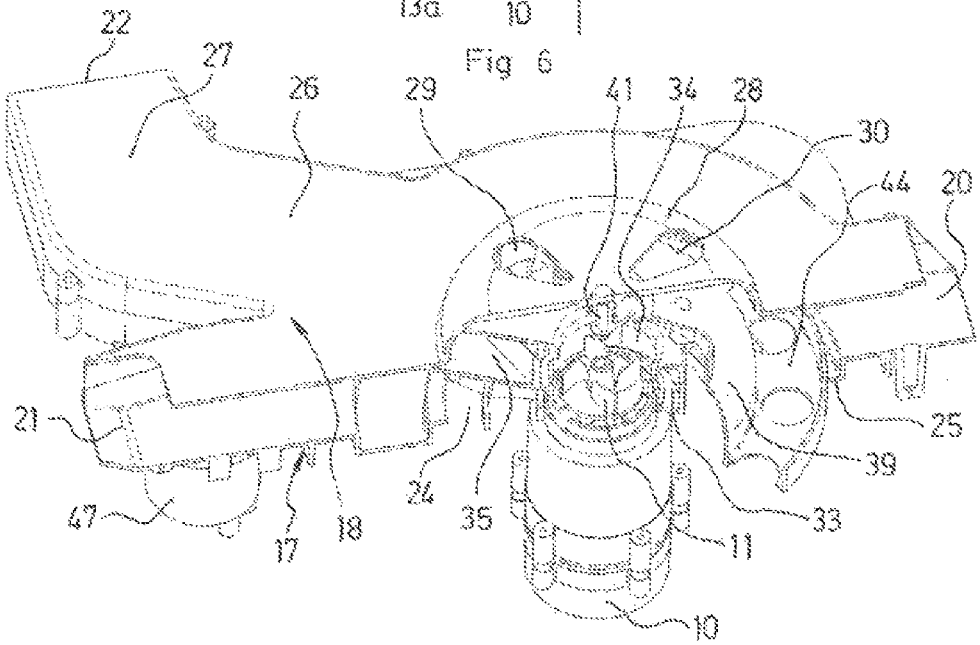
Figure 7A:
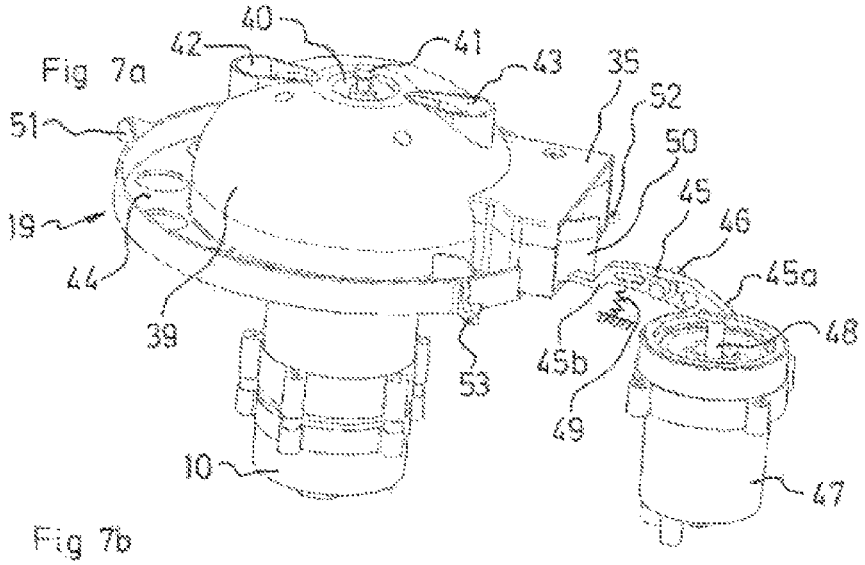
Figure 7B:
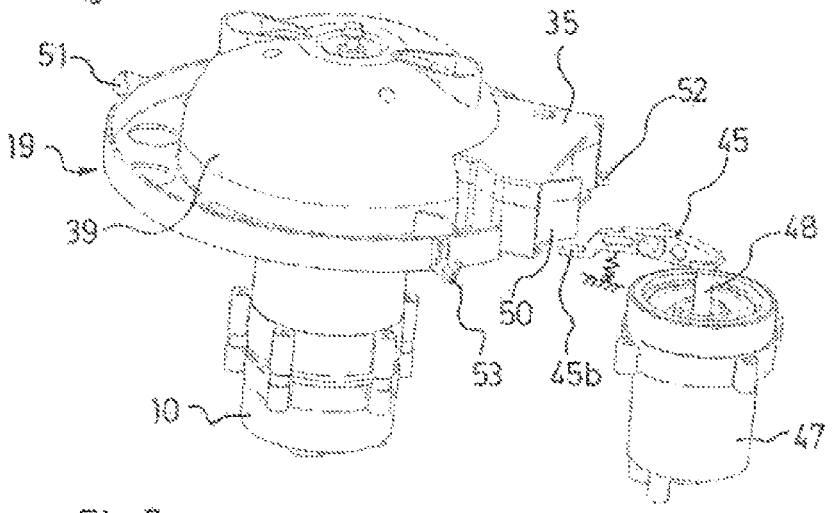
Figure 7C:
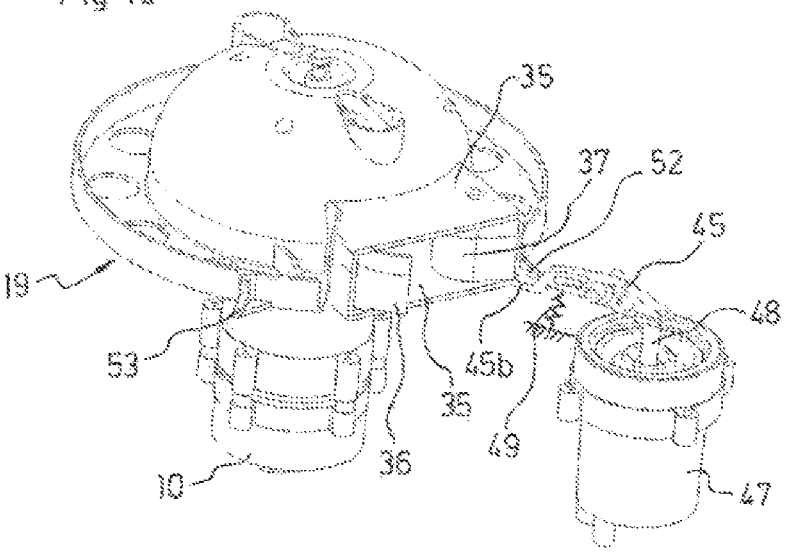
Figure 7D:
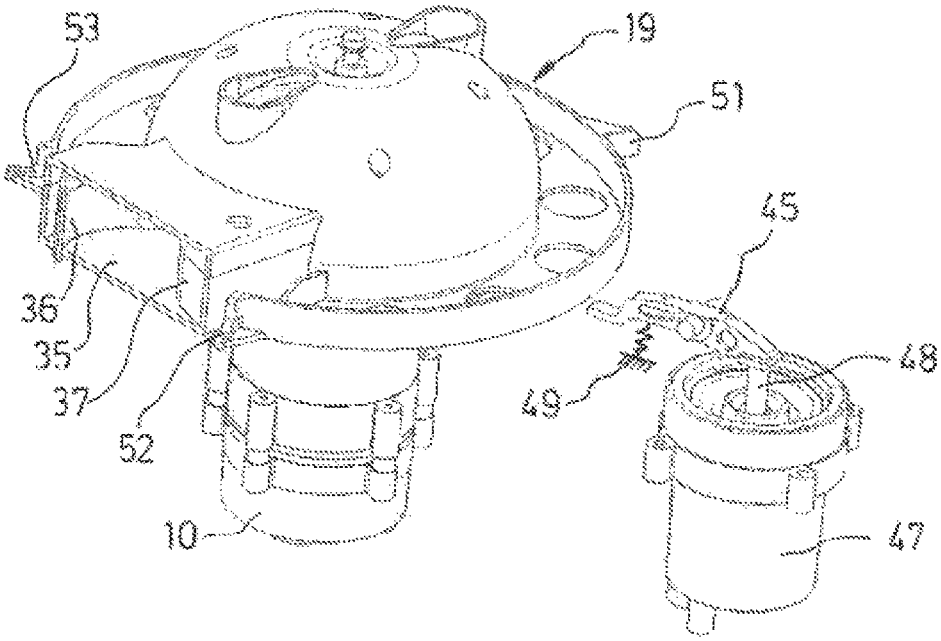
Figure 7E:
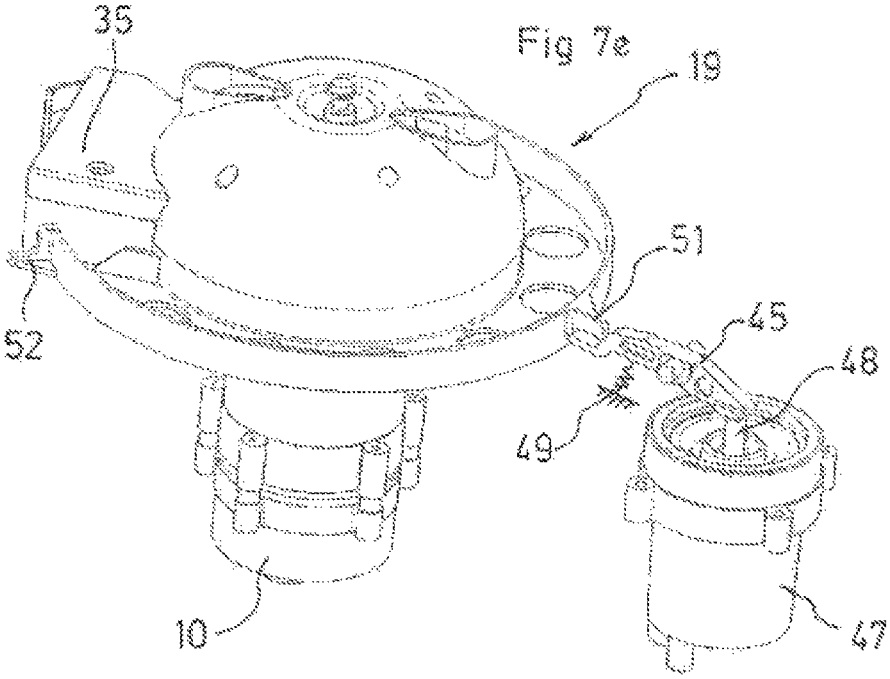
Figure 8A:
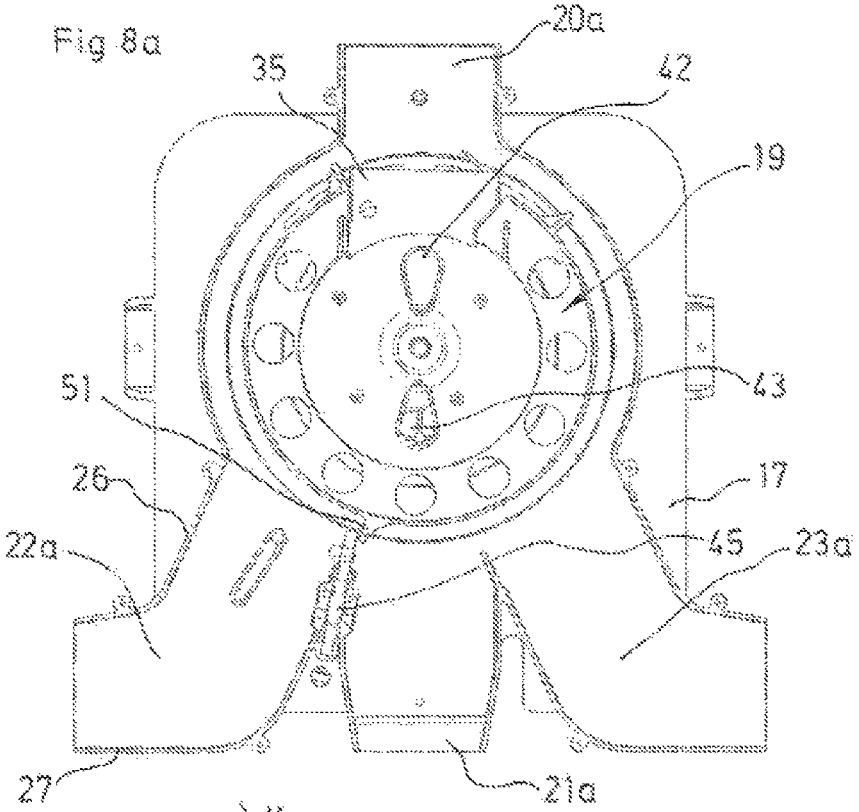
Figure 8B:
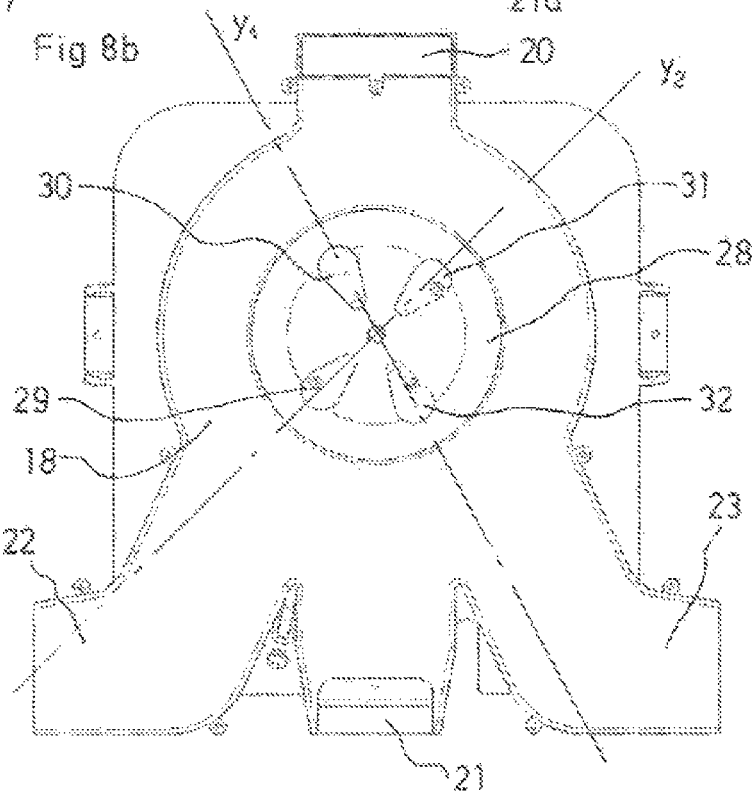
Figure 9A:
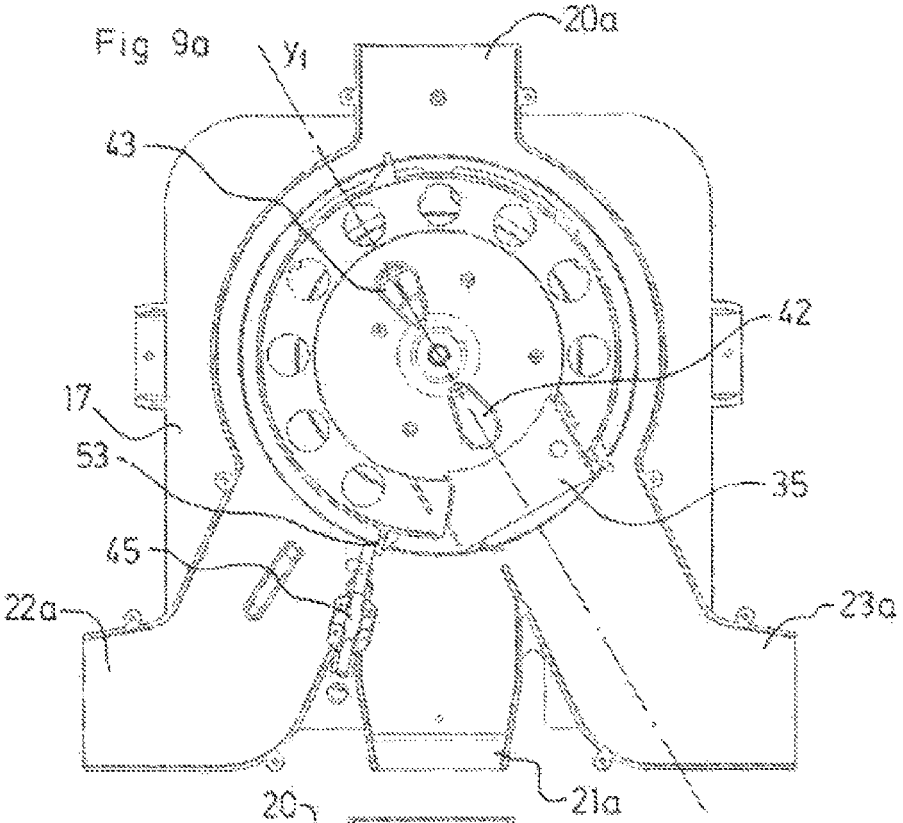
Figure 9B:
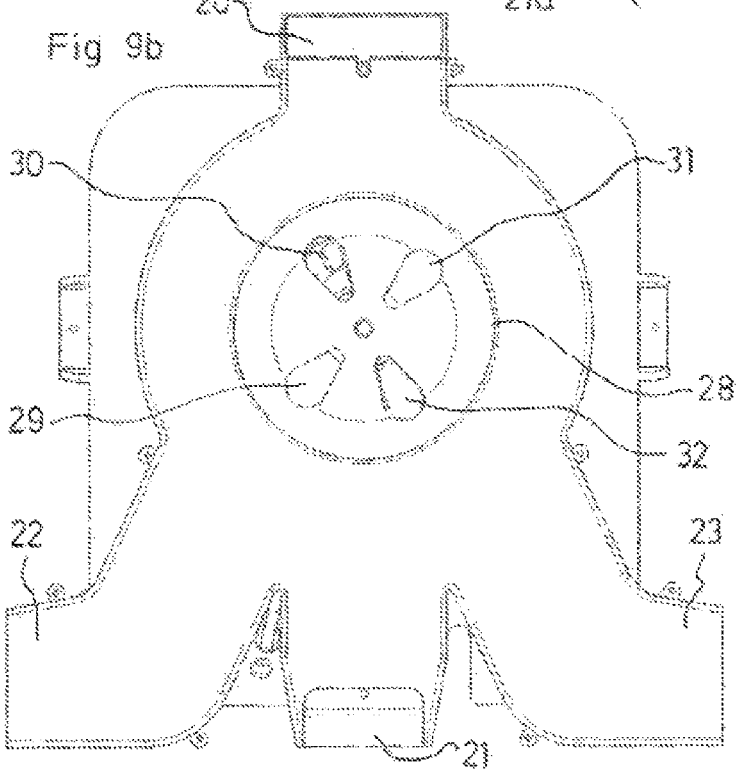

Other features, objects, and advantages of the invention will become apparent from the following detailed description with reference to the accompanying drawings which illustrate a preferred embodiment by way of non-limiting example. In these drawings:

FIG. 1 is a top perspective view of a cleaning device according to the invention, FIG. 2 is a bottom perspective view showing the cleaning device placed on its side in a position providing access to the filter pan, FIG. 2*a* is a detailed view of the lower wall of the filtration pan, FIG. 3 is a top perspective view of the cleaning device shown without its covering cowl, FIG. 4 is a top view in which the upper element of the shroud is shown detached from the cleaning unit;

FIGS. 5 and 6 are partial perspective views of the cleaning device according to the invention, FIGS. 7*a* to 7*e* are perspective views of the means for orienting the propelling water jet, representing various positions of said orienting means, FIGS. 8*a* and 8*b* are top views of the cleaning device according to the invention represented in one of the longitudinal propulsion positions of the propelling water jet, respectively without the upper shroud element (8*a*) and with the upper shroud element (FIG. 8*b*), and FIGS. 9*a* and 9*b* are top views of the cleaning device according to the invention represented in one of the lateral propulsion positions of the propelling water jet, respectively without the upper shroud element (9*a*) and with the upper shroud element (9*b*).

The cleaning device according to the invention represented in FIGS. 1 to 4 consists of a cleaning device with propelling water jet, adapted to travel along the bottom (P) of tanks or pools such as swimming pools.

This cleaning device firstly comprises a body 1 having the general form of a frame defining an inside volume that is substantially rectangular and parallelepipedic. This body 1 is supported by two axles, a front axle 3 and a rear axle 4, positioned at each of the longitudinal ends of said body; two wheels are mounted on the ends of each axle: two front wheels 5, 6 and two rear wheels 7, 8.

Conventionally, the two axles 3, 4 are mounted to rotate about parallel axes of rotation (x), and thus define a longitudinal axis of movement (y) of the cleaning device that is orthogonal to said axes of rotation (x).

As is particularly visible in FIG. 5, within the inside volume 2 defined by the body 1, the cleaning device comprises a cradle 9 integral with said body, supporting a centrifugal pump 10 for driving a radial turbine 11, in a position where said turbine rotates about an axis (z) perpendicular to the plane defined by the axes (x, y).

Moreover, the cradle 9 is housed inside a removable filtration pan 13, and defines a support surface for a filtration bag 12 suitable for collecting filtered material, such as suspended solids, settling inside said filtration pan.

This filtration pan 13 has a generally rectangular parallelepipedic shape combined with that of the inside volume 2 defined by the body 1, and comprises, as is particularly visible in FIGS. 2 and 4, two pivotable side handles that are manually actuated, such as 60, having latching pins such as 60*a* at the top, designed to cooperate with a bar 59 for locking said pins that is integral with the body 1.

As can be seen in FIG. 2, such a filtration pan 13 is accessible and can thus be removed and replaced when the cleaning device is in a position where said device is on its side.

The filtration pan 13 further comprises a lower wall 13*a* in which two suction ports 14, 15 are provided, rectangular in this example, arranged so that the longitudinal axes of symmetry of said suction ports are aligned along the same axis, which is parallel to the axis (x) of rotation of the wheels 5-8.

In addition, as represented in FIG. 2*a*, this filtration pan 13 has, on either side of each suction port 14, 15, along the longitudinal axis of movement (y), a lip 56, 57 extending along the edge of said suction port, of a height adapted to define, above the bottom wall (P), a suction slot of reduced height (e) designed to accelerate the flow of water and create jets in contact with said bottom wall that are able to clean said wall effectively.

As represented in FIG. 5, the filtration pan 13 also comprises two suction ducts 16 which each open into one of the suction ports 14, 15 and extend through the cradle 9 so as to open into the upper region of said cradle.

The cleaning device according to the invention further comprises two shroud plates 17, 18 adapted to be superimposed and positioned on the body 1, said plates being shaped so as to define:

- on the one hand, a housing for a rotary distributor 19 adapted to be supplied by means of the water jet produced by the radial turbine 11,
- on the other hand, four water jet propulsion conduits 20-23 for the water delivered by the rotary distributor 19.

To this end, the bottom plate 17, adapted to be secured to the body 1, comprises a center hole 24 formed so as to be centered on the axis of rotation (z) of the radial turbine 11, on the periphery of which is formed an annular track 25 for supporting and guiding the rotary distributor 19.

This bottom wall 17 also comprises four channels 20*a*-23*a* formed starting from the annular track 25 and consisting of:

- two axial channels, referred to as the front channel 20*a* and rear channel 21*a*, extending longitudinally along axis (y), one on either side of the annular track 25,
- two lateral channels 22*a*, 23*a* symmetrically extending one on either side of the rear channel 21*a*, and having bent longitudinal profiles so that each has an arm 26 that is radial relative to the annular track 25, and a transverse arm 27 parallel to axis (x) and adapted to end above one of the rear wheels 7, 8.

The second plate, which is the upper plate 18, has a shape complementary to that of the bottom wall 17 and:

- comprises four channels 20*b*-23*b* adapted to form, with the corresponding channels 20*a*-23*a* of the bottom plate, four fixed propulsion outlets: two longitudinal propulsion outlets 20, 21 and two lateral propulsion outlets 22, 23,
- forms a dome 28 of which the base has a diameter substantially equal to the diameter of the central opening 24 of the bottom plate 17, arranged directly above said central opening.

In addition, the dome 28 is pierced by four holes 29-32 distributed radially about the axis of rotation (z) and aligned in pairs along two axes y1 and y2 substantially offset angularly relative to the longitudinal axes of the radial arms 26 of the lateral propulsion outlets 22, 23.

The rotary distributor 19 firstly comprises a cylindrical suction chamber 33 arranged to accommodate the radial turbine 11 and equipped with an upper feed opening 34.

The suction chamber 33 also communicates with a radial propulsion duct 35 arranged so as to be positioned in the continuity of the fixed propulsion outlets 20-23 during the rotation of the rotary distributor 19.

Furthermore, as is particularly visible in FIGS. 7*a* to 7*e*, this propulsion duct 35 integrates members for deflecting the water jet propelled by the rotation of the turbine 11, arranged at its opening and adapted to generate rotation of the rotary distributor 19. In the example shown, these deflecting members consist of a convex projection 37 attached to one of the side walls of the propulsion duct 35, and of a concave wall 36 extending the other side wall of said propulsion duct.

The rotary distributor 19 further comprises, on the periphery of the suction chamber 33, a radial annular perforated wall 38, discontinued in the angular section corresponding to the location of the propulsion duct 35, said radial wall further forming, with said suction chamber, the base of a cap 39 defining a feed enclosure of the upper feed opening 34 of the suction chamber 33.

This cap 39 further comprises, externally, a central conical recess 40 for locking in translation the rotary distributor 19 by means of a pin 41 integral with the dome 28 so that it extends into said recess.

The cap 39 also comprises two openings 42, 43 arranged to come into coincidence with the openings 30, 32 of the dome 28 that are aligned on axis y1 in one of the lateral propulsion positions (FIGS. 9*a* and 9*b*), and with the openings 29, 31 of the dome 28 that are aligned on axis y2 in the other of the lateral propulsion positions.

Lastly, the rotary distributor comprises a radial annular band 44 running along the periphery of the base of the cap 39, adapted for positioning on the annular track 25 of the bottom plate 17.

The cleaning device also comprises means for indexing the angular position of the rotary distributor 19, to allow positioning the propulsion duct 35 so it faces and lies in the continuity of each of the fixed propulsion outlets 20-23.

These indexing means firstly comprise a lever 45 extending radially relative to the axis of rotation (z), hinged on an axis 46 orthogonal to said axis of rotation (z), and having a latch-shaped end 45*b* adjoining the peripheral region of the annular band 44 of the rotary distributor 19.

The indexing means also comprise means for actuating the lever 45, comprising an electromagnet 47 having a finger 48 arranged parallel to the axis of rotation (z), perpendicular to the end 45*a* of the lever 45 opposite the latch 45*b*, so as to cause said lever to tilt, lowering the latch 45*b* when said electromagnet is supplied with power.

These actuating means further comprise a spring 49 positioned under the arm of the lever 45 that comprises the latch 45*b*, causing said lever to tilt and raise said latch when said electromagnet 45 is not being supplied with power.

Lastly, the indexing means comprise radial stop members 50-53 protruding from the periphery of the annular band 44 of the rotary distributor 19, and positioned so that each one defines one of the propulsion positions of said rotary distributor.

In addition, the two stop members 52, 53 defining the lateral propulsion positions of the rotary distributor 19 are located at the same height along the axis of rotation (z), and are staggered along this axis (z) relative to the two stop members 50, 51 defining the longitudinal propulsion positions of said rotary distributor, which themselves are located at a same height. Specifically:

- the two stop members 52, 53 defining the lateral propulsion positions are designed to catch the latch 45*b* when it is in the lowered position obtained when the electromagnet 47 is supplied with power,
- the two stop members 50, 51 defining the longitudinal propulsion positions are adapted to catch the latch 45*b* when it is in the raised position obtained when the electromagnet 47 is not being supplied with power.

It should also be noted that the stop member 50 defining one of the longitudinal propulsion positions consists of the concave wall 36 acting as a deflecting member.

Lastly, the cleaning device comprises a cover 54 covering the shroud elements 17 consisting of the lower and upper plates 18.

This cover 54 is provided with a handle 55 for grasping the cleaning device for transport. This handle 55 extends parallel to the axis (x) of rotation of the wheels 5-8, and is located on the rear portion of the cover 54, forming an additional support base for the cleaning device in the position shown in FIG. 2 where the device is on its side to provide access to the filtration pan 13.

According to the cleaning device of the invention, and firstly, the rotation of the radial turbine 11 generated by supplying power to the centrifugal pump 10 causes water to be suctioned into the suction chamber 33 through fluid passageways represented in FIG. 5, including the ducts 16, and adapted to allow water to travel between the suction ports 14, 15 and the upper feed opening 34 of said suction chamber.

The water drawn into the suction chamber is propelled into the propulsion duct 35 as a propelling water jet, causing rotation of the rotary distributor 19 due to the presence of the deflecting elements 36, 37 and causing the movements (pivoting and longitudinal displacements) of the cleaning device.

Selection of the movement sequences is achieved by programming the means for powering the electromagnet 47 according to the following general principles:

- an absence of power causes a longitudinal displacement in a movement direction,
- an electric pulse reverses the longitudinal movement direction: the latch 45*b* is released from the stop member 50, 51 against which it was initially abutting and it is immediately returned to its raised position where it then catches on the stop member 51, 50 defining the other longitudinal propulsion position (sequence in FIGS. 7*a*-7*b*-7*d*-7*e*),
- power is supplied for time t, leading to the cleaning device pivoting by an angle that is a function of t, in a rotation direction that is a function of the previous direction of longitudinal displacement: the latch 45*b* is released from the stop member 50, 51 against which was initially abutting and remains in its lowered position where it then catches on one of the stop members 52, 53 defining one of the lateral propulsion positions (sequence in FIGS. 7*a*-7*b*-7*c*).

It is understood that other versions may also be considered and allow two successive pivots . . . .

However, the most common movement sequences comprise:

- a first longitudinal movement for a predetermined length along axis (y) in a first movement direction,
- a second longitudinal movement for a predetermined length in a reverse movement direction,
- and pivoting for a period of time suitable for rotating the cleaning device by a predetermined angle.

For example, in the case of a rectangular pool, these sequences are combined to perform cycles comprising:

- a first sequence where the cleaning device moves in both directions for a length corresponding to one of the dimensions of the submerged surface, and at the end of which it pivots by an angle of 90°,
- a second sequence where the cleaning device moves in both directions for a length corresponding to the second dimension of the submerged surface, and at the end of which it pivots by an angle of 90°.

It should also be noted that, as represented in FIGS. 9*a* and 9*b*, during each pivot of the cleaning device, the two openings 42, 43 come into coincidence with two of the openings, in the example 30, 32, of the dome 28 such that the suction chamber 33 is directly fed by the water traveling through said openings. Therefore, when pivoting, the cleaning device is not subjected to the adhesive force generated by the negative pressure resulting from drawing water through the suction holes (Bernoulli effect).

In addition, when pivoting, the flow from the suction chamber is independent of the fill level and/or clogging level of the filtration pan 13. Therefore, the amplitude of the pivots remains constant regardless of the fill level and/or clogging level and can be precisely determined.

It is therefore possible to program the pivoting to avoid winding phenomena in the power cord.

It should also be noted that, according to the principle of the invention, the cleaning device could have two lateral propulsion outlets 22, 23 as described above, or could have a single lateral propulsion outlet 22 or 23, two lateral propulsion outlets 22 (or 23) each placed at one of the ends of the cleaning device, on the same side of said device, or even three or four lateral propulsion outlets.

Such a cleaning device with propelling water jet and having a simple centrifugal pump 10 therefore performs:

- longitudinal movements along axis (y), in both movement directions,
- and pivots to angles predetermined as a function of the length of time the water jet is oriented in a lateral propulsion direction.

It therefore combines the advantages of current devices having a propelling water jet (simplicity, low cost . . . ) and the ability to clean the entire surface of the bottom walls of tanks or pools in an efficient manner with no need for human intervention.

The invention claimed is:

1. A cleaning device for cleaning a submerged surface, comprising:

- a housing having a wall defining an interior space, the housing having a longitudinal axis, a lateral axis, at least one inlet defined through the housing, and a plurality of outlets defined through the housing including a first longitudinal outlet on a first longitudinal side of the housing, a second longitudinal outlet on a second longitudinal side of the housing, and a first lateral outlet on a first lateral side of the housing;

a turbine located inside the interior space and rotatable to generate a liquid jet from liquid that passes through the at least one inlet;

a rotary distributor in the interior space that includes a propulsion conduit that receives the liquid jet generated by the turbine, the rotary distributor rotatable about an axis of rotation to position the propulsion conduit with one of the plurality of outlets to expel the liquid jet through the one of the plurality of outlets; and a plurality of wheels mounted to the housing for supporting the housing during movement of the housing.

2. The cleaning device of claim 1 wherein the first lateral outlet through the housing is substantially aligned with an axis of rotation of at least one of the plurality of wheels.

3. The cleaning device of claim 2 wherein the plurality of outlets includes a second lateral outlet on a second lateral side of the housing substantially aligned with the axis of rotation of at least one of the plurality of wheels.

4. The cleaning device of claim 1 wherein the longitudinal axis substantially of the housing bisects an axis of rotation of at least one of the plurality of wheel and the first longitudinal outlet and the second longitudinal outlet are substantially aligned along the longitudinal axis on opposing longitudinal sides of the housing.

5. The cleaning device of claim 1 further comprising:

an abutment member in the interior space proximate the rotary distributor, the abutment member movable between a first position and a second position; and a plurality of stop members protruding from a periphery of the rotary distributor, each one of the plurality of stop members positioned to align one of the plurality of outlets with the jet conduit when the one stop member is engaged by the abutment member;

a driver operable to move the abutment member between the first position and the second position where the abutment member is aligned to engage one of the plurality of stop members in the first position and is aligned to disengage from the one of the plurality of stop members in the second position to allow the rotary distributor to be rotatable to move the jet conduit between alignments with at least two of the plurality of outlets.

6. The cleaner device of claim 5 further comprising wherein the abutment member is aligned to engage one of the plurality of stop members associate with one of the first and second longitudinal outlets in the first position and to engage one of the plurality of stops associated with the first lateral outlet in the second position.

7. The cleaner device of claim 5 wherein the driver comprises an electromagnet coupled to a finger that extends parallel to an axis of rotation of the rotary distributor, the electromagnet configurable to move the finger along an axis parallel to the axis of rotation of the rotary member, the device further comprising a lever having the abutment extending from a first end and a second end coupled to the finger such that the latch moves between the first and second positions in response to movement of the finger by the electromagnet.

8. The cleaner device of claim 7 further comprising a spring connected to the lever to bias the abutment member in one of the first and the second positions.

9. The cleaner device of claim 1, further comprising top cover comprising the plurality of outlets and the first lateral outlet, said top cover being fixed relative to the axis of rotation.

10. The cleaner device of claim 1 wherein the rotary distributor comprises a suction chamber arranged to accommodate the turbine, equipped with a passage providing communication between the turbine and the propulsion conduit.

11. The cleaner device of claim 10 wherein the suction chamber of the rotary distributor comprises a feed opening in an upper area of the suction chamber, and the device further comprises fluid passageways incorporating filters adapted to allow liquid to travel between the at least one inlet arranged in a lower portion of the housing and the feed opening of the suction chamber.

12. The cleaner device of claim 10 wherein the rotary distributor comprises water passage openings arranged opposite the feed opening of the suction chamber and adapted to be unblocked when the jet conduit is with the first lateral outlet, and to be blocked when the jet conduit is with at least one of the first and second longitudinal outlets.

13. An apparatus for cleaning a submerged surface comprising:

a housing having a lower portion having a bottom surface and an upper portion having a top surface, the lower portion and the upper portion are rotatably fixed relative to one another during use and combine to define an interior space, the lower portion having a suction duct having a suction port arranged through the bottom surface, and the upper portion having a plurality of channels, each of the plurality of channels having an outlet through the upper portion of the housing;

a rotary distributor positioned in the interior space and comprising a propulsion duct, said rotary distributor being rotatable to align the propulsion duct with anyone of the plurality of channels, the rotary distributor comprising a suction chamber equipped with a passage providing communication with the propulsion duct;

fluid passageways incorporating filters adapted to allow liquid to travel between the suction port arranged in the bottom surface of the fixed lower portion of the housing and the feed opening of the suction chamber; and a radial turbine rotatable by a motor to generate a liquid jet in the rotary distributor, the passage of the suction chamber directing the liquid jet to the propulsion duct to be expelled through the outlet of one of the plurality of channels aligned with propulsion duct to provide a propulsion force.

14. The apparatus for cleaning a submerged surface of claim 13, wherein one of the outlets is substantially aligned with an axis of rotation of at least one of the plurality of wheels.

15. The apparatus for cleaning a submerged surface of claim 14, wherein the plurality of outlets includes a second lateral outlet on a second lateral side of the housing substantially aligned with the axis of rotation of at least one of the plurality of wheels.

16. The apparatus for cleaning a submerged surface of claim 13, wherein the suction chamber of the rotary distributor comprises a feed opening in an upper area of said suction chamber.

* * * * *